United States Patent [19]

Marziano et al.

[11] 4,216,721

[45] Aug. 12, 1980

[54] THERMITE PENETRATOR DEVICE (U)

[75] Inventors: Samuel J. Marziano, Glenolden; Reed E. Donnard, Huntingdon Valley, both of Pa.

[73] Assignee: The United Stated of America as represented by the Secretary of the Army, Washington, D.C.

[21] Appl. No.: 316,602

[22] Filed: Dec. 22, 1972

[51] Int. Cl.[3] ..... F42B 11/24

[52] U.S. Cl. ..... 102/90; 102/6; 102/66

[58] Field of Search ..... 102/90, 66, 6

[56] References Cited

U.S. PATENT DOCUMENTS

| | | | |
|---|---|---|---|
| 1,299,869 | 4/1919 | Steinmetz | 102/66 X |
| 2,253,364 | 8/1941 | Cohen | 102/6 X |
| 2,391,242 | 12/1945 | Hurrey | 102/90 |

*Primary Examiner*—Harold J. Tudor

*Attorney, Agent, or Firm*—Nathan Edelberg; Robert P. Gibson; A. Victor Erkkila

[57] ABSTRACT

Controlling the release from a conical ceramic crucible of molten thermite reaction products (generally, iron and alumina) to effect optimum penetration of metallic targets by said molten products through the use of metallic discs which are completely protected on their sides against the molten products, thus forcing these molten products to melt the discs sequentially from top to bottom, resulting in a delay of flow of the molten products from the conical crucible to thus permit the molten iron, heavier than the molten alumina, to substantially unimpededly transfer its heat to the metallic target, the molten iron being more efficient in melting metallic materials than the molten alumina.

5 Claims, 3 Drawing Figures

THERMITE PENETRATOR DEVICE (U)

The invention described herein may be manufactured, used, and licensed by or for the Government for governmental purposes without the payment to us of any royalty thereon.

This invention relates to thermite reactions and more particularly concerns improved means for utilizing such reactions in the penetration of metallic targets.

In the open or surreptitious destruction of steel safes containing strategic materials therewithin, or in the immobilization of enemy tanks, vehicles, and the like, or in the disengagement of welded steel or metallic members, and for other diverse or like reasons, it is known that the penetration of metallic components thereof by hot molten metal provides an economical, reliable and rapid method for such destruction.

The well-known thermite process is based on the reaction of various metallic oxides with a specified metal resulting in the oxidation of the metal to its oxide and the reduction of the metallic oxide to the free metal, the reaction being extremely exothermic and oxygen self-sustaining.

A standard thermite reaction is:

$$2Al+Fe_2O_3 \rightarrow Al_2O_3+Fe$$

and the chemical constituents involved therein, as in all thermite reactions, are stoichiometrically balanced. Examples of other thermite reactions are:

$$3Zr+2B_2O_3 \rightarrow 3ZrO_2+4B$$

$$6Li+MoO_3 \rightarrow 3Li_2O+Mo$$

$$6Li+WO_3 \rightarrow Li_2O+W$$

$$8Al+3Mn_3O_4 \rightarrow 4Al_2O_3+9Mn$$

$$10Al+3V_2O_5 \rightarrow 5Al_2O_3+6V$$

A commonly used thermite mixture comprises the reaction of ferric oxide granules with aluminum granules to produce molten iron and aluminum oxide slag:

$$3Fe_3O_4+8Al \rightarrow 9Fe+4Al_2O_3$$

Upon ignition of the above mixture, molten iron, having a melting point of approximately 2750° F. and a density of about 7, and molten alumina, or aluminum oxide, having a melting point of approximately 3722° F. and a density of about 4, will be formed. The peak temperature of the reaction will be in excess of 4000° F. The reaction is caused to take place in a reaction vessel or ceramic crucible, suitably of fused silica, although any refractory ceramic material capable of withstanding the temperatures involved may be used.

Some solidification of the molten aluminum oxide will form a slag on the initially cool surface of the crucible. The molten mass however, representing both aluminum oxide and iron, in accordance with prior art practices, would be left in the crucible for a short period of time and then allowed to flow onto the metallic target for penetration thereof.

Optimum damage to a target, using a specified quantity of thermite mixture, will depend on the reaction mass being held back in the crucible a specified amount of time before being permitted to flow onto a target. The specified time will generally depend on the amount of time required for the molten metal (iron) to substantially settle to the bottom of the crucible, or stated another way, the time required for the lighter metal oxide (aluminum oxide) to rise to the upper portions of the reaction mass.

It is known that both molten iron and molten aluminum oxide will form substantially homogeneously throughout the crucible volume. If the mixture were allowed to flow out of the conical crucible immediately upon completion of the reaction, both molten components would contact the target surface substantially simultaneously. This would not result in optimum penetration, i.e., minimum amount of thermite mixture used to maximum volume of target metal removed for a given thickness of metal plate, since the mechanism of penetration is directly related to the rate of heat transfer to each succeeding surface of unmelted target metal, and when both reaction products are released together, poor penetration will result, since the aluminum oxide will tend to solidify on the target surface as the average temperature of the flowing molten mass lowers with time. This is so because the melting point of aluminum oxide, as aforementioned, is considerably higher than the melting point of the iron and will thus solidify considerably sooner than the molten iron.

On the other hand, if the molten mass of the thermite reaction is held back in the crucible for a controlled period of time before flowing therefrom, the lighter aluminum oxide will migrate to the top of the crucible and the heavier iron will collect at the bottom. The molten iron will flow from the crucible and contact the target prior to the aluminum oxide to thus cause optimum heat transfer thereto. As aforediscussed, the iron will remain in its molten state for a longer period of time than will aluminum oxide because of its lower melting point. Thus, the flowing molten iron, rather than the aluminum oxide slag, will transfer its heat to the target to effect optimum penetration thereof.

It should be noted herein that molten iron will even penetrate steel targets since the temperature of the molten iron will be considerably above the melting point of the steel. As aforementioned, the peak reaction temperature will be in excess of 4000° F., and the molten iron will be raised to a temperature above its melting point as a result of the thermite reaction. Of course, one skilled in the art would know which of the several thermite mixtures to employ for specific metal target destruction.

It is therefore an object of this invention to provide means for utilizing thermite reactions such that optimum penetration of metallic targets is achieved.

The exact nature of this invention as well as other objects and advantages thereof will be apparent from consideration of the following description and drawings wherein.

Figure 1:
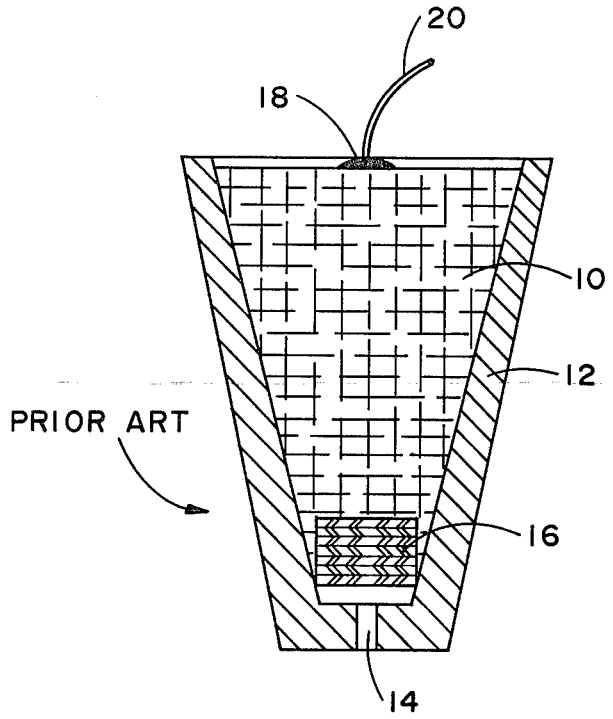
FIG. 1 is a vertical section illustrating the Prior Art thermite penetrator device.

Referring now to the drawings, and more particularly to FIG. 1 thereof, a thermite mixture 10, suitably of the $Fe_3O_4$ and Al type aforedescribed, will be contained within a coverless, conically-shaped ceramic crucible 12, made of fused silica, or other refractory material capable of withstanding the reaction temperature of the specific thermite selected and not unduly reactive therewith.

A hole 14 is centrally disposed at the bottom of the crucible for flow of molten reaction products therethrough. A plurality of metal discs 16, suitably of mild steel, are placed adjacent a bottom portion of the crucible, the diameter of the discs being of a size such that the discs rest directly over the hole 14, or are disposed in spaced relation thereto, as shown in FIG. 1.

A starter material 18 is placed atop the thermite mixture and an igniter cord 20 is disposed within the starting material.

The starter material may be any material which is readily ignitable upon application thereto of a flame, or lighted fuse, for example, and will preferably comprise, by weight:

| | |
|---|---|
| Fe powder | 28.0% |
| Al powder | 41.7% |
| Barium chlorate | 27.0% |
| Oxygen (associated with Al) | 3.3% |

The igniter cord should desirably be a slow burning material of about 1.5 inches/second, and may partake of ordinary string coated with a chemical composition which will provide this approximate rate of burning. Of course, faster burning cords are equally usable with the device if of such length that the operator will have sufficient time to remove himself from the vicinity after igniting the cord.

Figure 2:
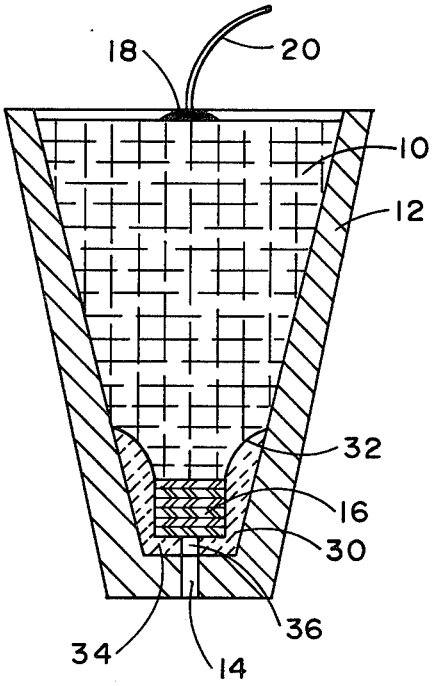
FIG. 2 is a vertical section of an embodiment of the invention, illustrating means for protecting the metallic discs.
Figure 3:
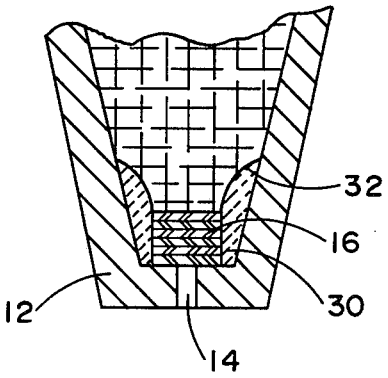
FIG. 3 is a modification of the embodiment shown in FIG. 2.

Referring now to FIGS. 2 and 3, a refractory piece or disc protector 30 is disposed about discs 16 such that the sides thereof do not contact thermite mixture 10. The molten thermite reaction products cannot now attack the discs 16 at their peripheral or side portions to gain rapid access to hole 14 without first vertically penetrating the entire stack of discs, thus providing the necessary delay to permit the molten metal to substantially settle to the bottom of the crucible and to pass through hole 14 to provide optimum penetration of the target. Of course, additional discs may be used for additional delay.

The refractory disc protector need only be of such refractoriness that it will not melt or substantially deform when subjected to the thermite reaction. Asbestos, thoria, hafnium carbide, and the like, have been found to work admirably well. The protector piece may be fabricated by any of the standard processes, such as casting, pressing, and the like, and will normally include a throat portion 32, such that the molten reaction products will be directed onto the discs 16. The outer portions of protector piece 30 will fit snugly within the lower portions of the crucible.

The protector modification shown in FIG. 3 may be a "rammable" refractory, such as mullite, for example, which may be "rammed" into place around discs 16 for protection of their sides from the molten reaction products, and differs from the embodiment shown in FIG. 2 in that discs 16 rest directly over hole 14, thus obviating any necessity for protector piece 30 having bottom portion 34 and central hole 36.

It is apparent from the above description that we have provided a thermite penetrator device which effects a controlled delay of thermite reaction products thus permitting molten metal rather than molten metal and molten oxide to penetrate the metal target for optimum damage thereto. Our device involves no refractory plug which must be pulled, and which requires a minimum "stand-off", i.e., a minimum distance between the bottom of the crucible and top of target, and no operator to pull the plug, the type and height of discs effectively dictating the time when molten metal will flow onto the target.

We wish it to be understood that we do not desire to be limited to the exact details of construction shown and described, for obvious modifications will occur to a person skilled in the art.

We claim:

1. In a thermite penetrator device for destroying a metal target comprising a refractroy crucible containing a thermite mixture therewithin, said crucible having a plurality of metal discs disposed adjacent a bottom portion of said mixture and crucible, said discs providng a space therearound between said discs and crucible, said discs being devoid of any chemical reaction with said thermite mixture, a readily ignitable starter material atop said thermite mixture, an igniter cord contacting said starter material and an exit hole in said crucible below said discs for passing molten thermite reaction products therethrough, said products comprising molten metal and molten oxide, the improvement therewith comprising a refractory protector piece disposed within said space between said discs and said crucible and surrounding all peripheral portions of said discs and in contacting relation with all of said peripheral portions, the upper portions of said refractory protector piece being in direct contact with said thermite mixture, such that said molten thermite reaction products must melt and pass vertically through each of said discs whereby heavier molten metal will pass through said exit hole to penetrate said target prior to said molten oxide.

2. The device of claim 1 wherein said refractory protector piece mates substantially snugly within bottom-most portions of said crucible.

3. The device of claim 2 wherein said protector piece includes a throat at its upper portions for directing said molten reaction products to pass vertically through each of said discs.

4. The device of claim 3 wherein said protector piece has a bottom portion for supporting said discs thereabove, said bottom portion having a hole therethrough aligned with said exit hole in said crucible.

5. The device of claim 3 further characterized by said protector piece being a rammable refractory.

* * * * *